US007810193B1

(12) United States Patent
Ennis et al.

(10) Patent No.: US 7,810,193 B1
(45) Date of Patent: Oct. 12, 2010

(54) INFLATABLE SUPPORT CUSHION

(76) Inventors: Dianna Ennis, 1710 W. Fury Rd., Fountaintown, IN (US) 46130; Trisha L. Ennis, 1710 W. Fury Rd., Fountaintown, IN (US) 46130

( * ) Notice: Subject to any disclaimer, the term of this patent is extended or adjusted under 35 U.S.C. 154(b) by 0 days.

(21) Appl. No.: 12/470,362

(22) Filed: May 21, 2009

(51) Int. Cl.
*A47C 20/00* (2006.01)
*A47D 13/00* (2006.01)

(52) U.S. Cl. ..... 5/655.3; 5/655; 5/654; 297/284.6; 297/219.12

(58) Field of Classification Search ..... 5/644, 5/645, 655, 655.3, 654, 633; 297/284.6, 297/219.12, 452.41
See application file for complete search history.

(56) References Cited

U.S. PATENT DOCUMENTS 2,728,926 A * 1/1956 Emery ..... 5/644
3,112,956 A * 12/1963 Schick et al. ..... 297/219.1
3,115,647 A * 12/1963 Emery ..... 5/644
3,235,892 A * 2/1966 Emery ..... 441/130
3,253,861 A * 5/1966 Howard ..... 297/452.43
4,923,247 A * 5/1990 Malmstrom ..... 297/4
5,095,567 A 3/1992 Kenoyer
5,544,378 A * 8/1996 Chow ..... 5/644
5,996,153 A 12/1999 Slater et al.
6,012,778 A 1/2000 Peterson
6,233,767 B1 5/2001 Horowitz
D443,461 S 6/2001 Hall et al.
6,354,665 B1 3/2002 Ross
7,048,703 B2 * 5/2006 Riach ..... 602/13

* cited by examiner

*Primary Examiner*—Michael Trettel

(57) ABSTRACT

An inflatable support cushion comprising a T-shaped cushion component divided into a center space, a first side extension, a second side extension, and a bottom extension, wherein the cushion component can be inflated with air via a valve; and a first joint in between the center space and the first side extension, a second joint in between the center space and the second side extension, and a third joint in between the center space and the bottom extension; each joint being a place where the top surface is bent inwardly toward the bottom surface; wherein the cushion component can be slightly bent at each joint.

2 Claims, 4 Drawing Sheets

INFLATABLE SUPPORT CUSHION

FIELD OF THE INVENTION

The present invention is directed to an inflatable pillow, more particularly to an inflatable pillow or cushion for helping support a baby or child in a seat device.

BACKGROUND OF THE INVENTION

Babies and infants may have trouble standing upright in various seat devices such as walkers or stationary exercisers, particularly if the seat device is too big for the baby or infant. The present invention features an inflatable support cushion for helping support a baby or child in a seat device such as a walker, a jumper seat, a stationary exerciser, or the like. The inflatable support cushion of the present invention can help take up extra space between the seat and the baby's body.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
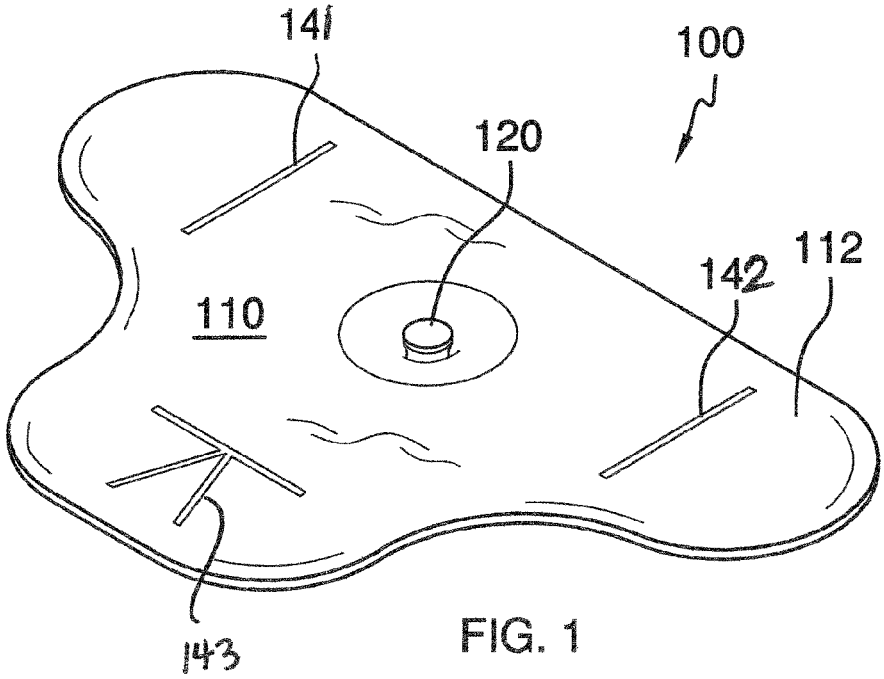
FIG. 1 is a perspective view of the inflatable support cushion of the present invention, wherein the cushion component is not inflated.
Figure 2:
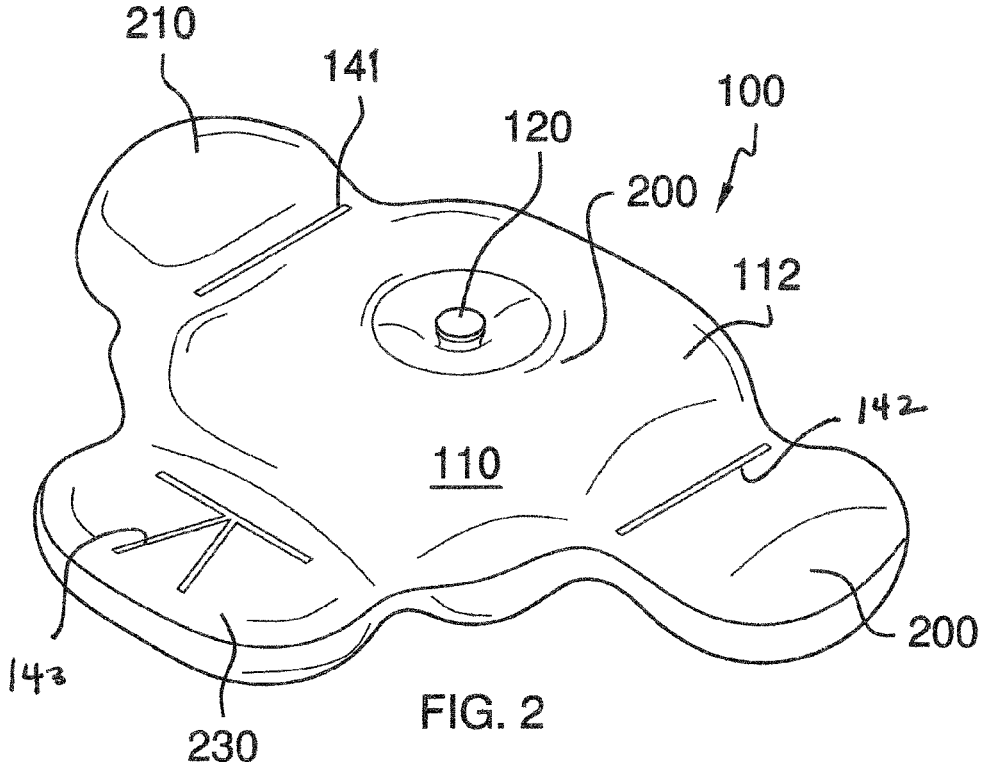
FIG. 2 is a perspective view of the inflatable support cushion of the present invention, wherein the cushion component is inflated.
Figure 3:
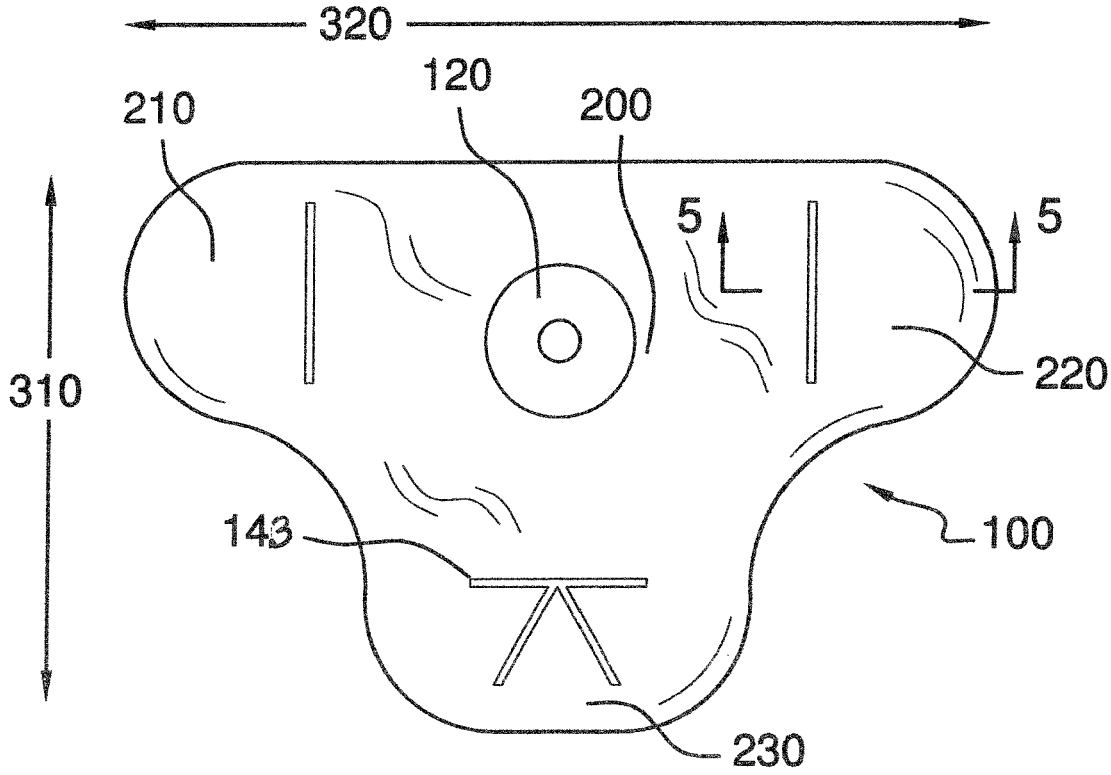
FIG. 3 is a top view of the inflatable support cushion of the present invention.
Figure 4:
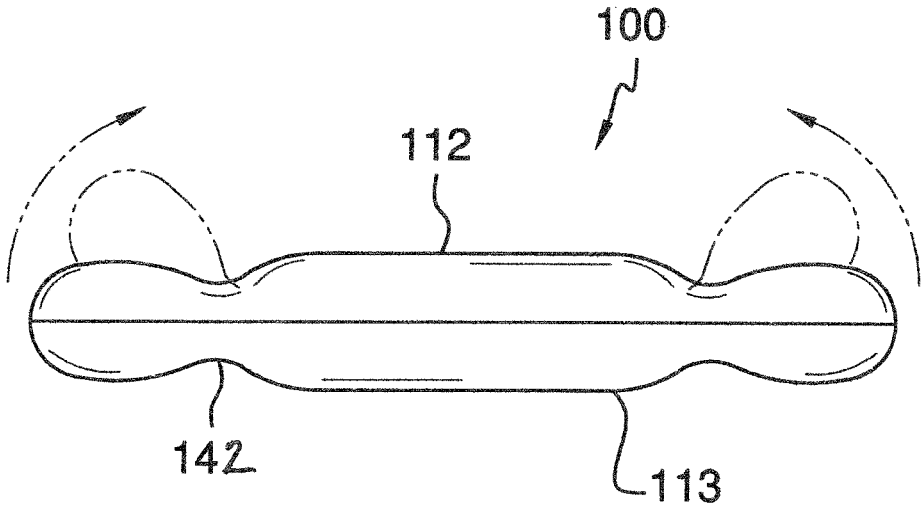
FIG. 4 is a side view of the inflatable support cushion of the present invention.
Figure 5:
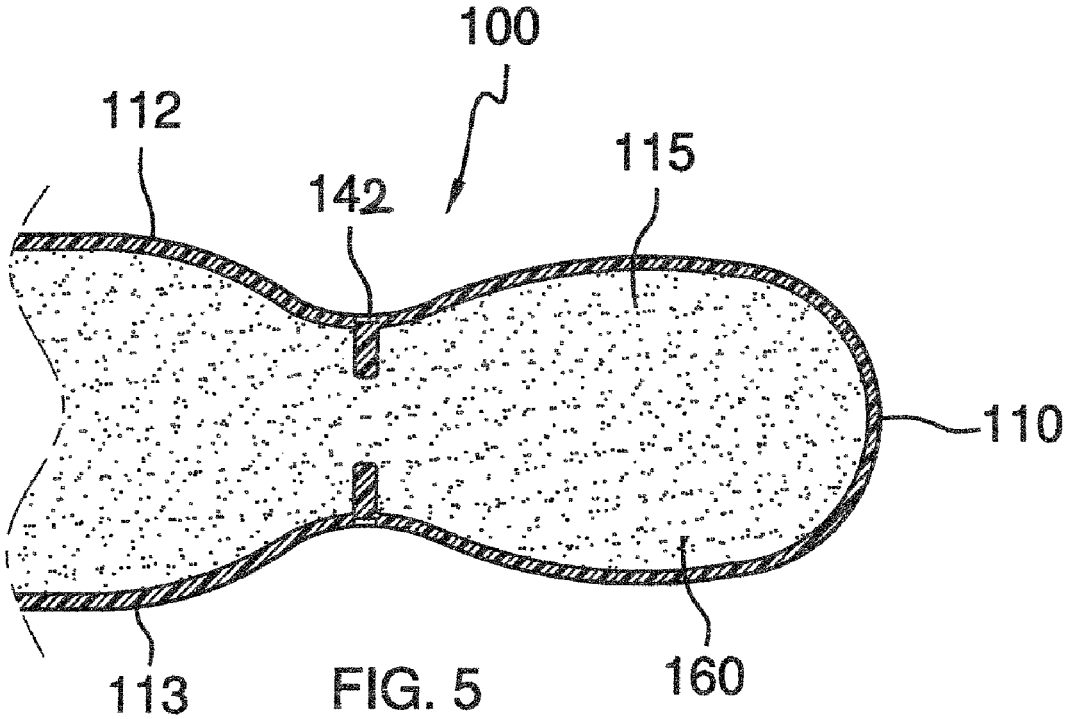
FIG. 5 is a side cross sectional view of the inflatable support cushion of the present invention.
Figure 6:
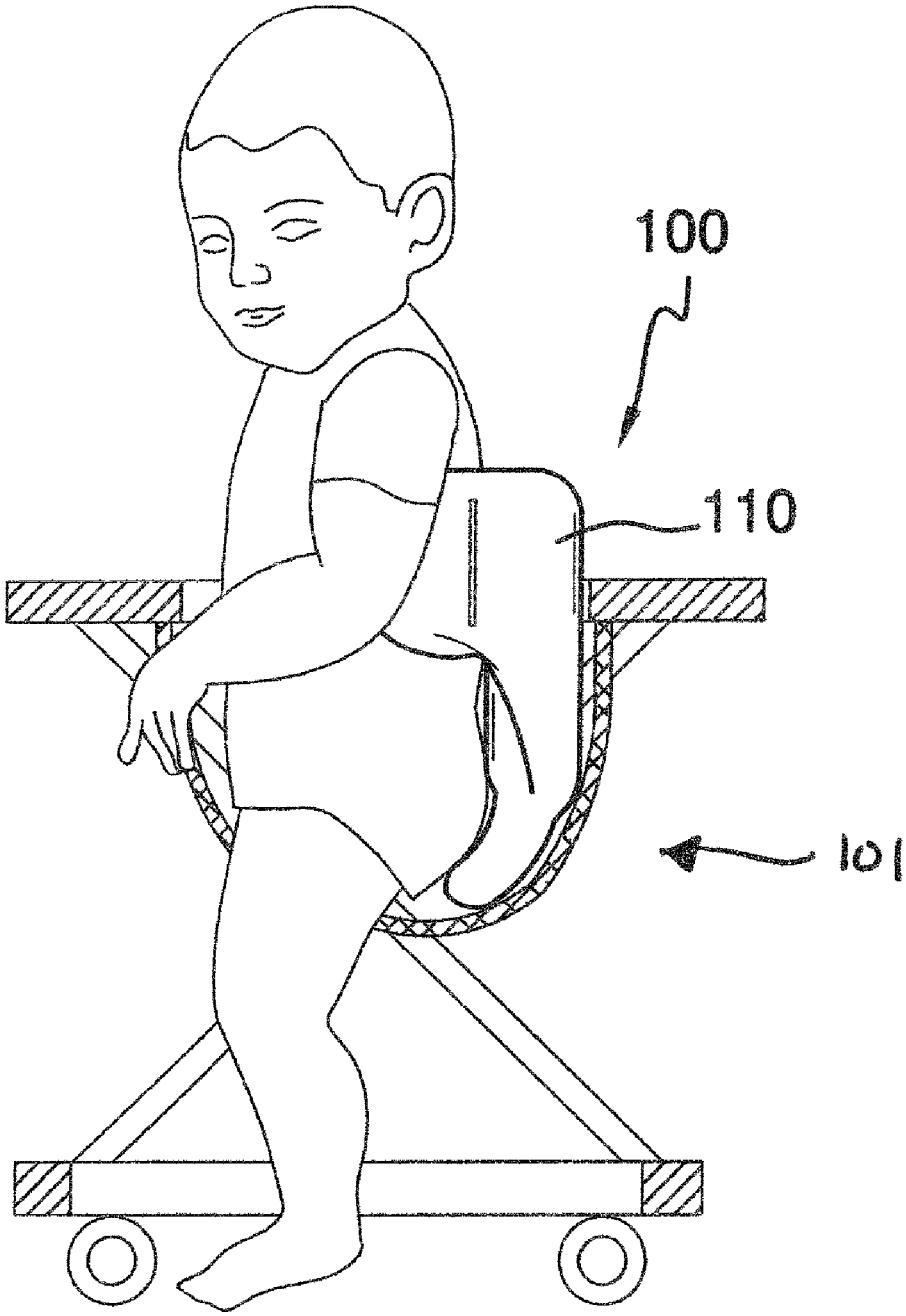
FIG. 6 is a side view of the inflatable support cushion of the present invention, wherein the cushion is used in combination with a seat device.

The following is a listing of numbers corresponding to a particular element refer to herein:

100 inflatable support cushion
101 seat device
110 cushion component
112 top surface of cushion component
113 bottom surface of cushion component
115 inner cavity of cushion component
120 valve
141 first joint
142 second joint
143 third joint
160 air
200 center space
210 first side extension
220 second side extension
230 bottom extension
310 length
320 width Referring now to FIGS. 1-6, the present invention features an inflatable support cushion 100 for helping support a baby or child in a seat device 101 such as a walker, a jumper seat, a stationary exerciser, or the like. Seat devices 101 are not limited to devices for helping a child sit and include all devices that help children stand as well. In some embodiments, the inflatable support cushion 100 of the present invention can help take up extra space between the seat device 101 and the baby's body.

The inflatable support cushion 100 comprises a generally hollow cushion component 110 having a top surface 112, a bottom surface 113, an inner cavity 115, and a valve 120 movable between an open position and a closed position for respectively allowing or preventing access to the inner cavity 115. The cushion component 110 can be inflated with air 160 via the valve 120.

The cushion component 110 is generally T-shaped having a center space 200, a first side extension 210, a second side extension 220, and a bottom extension 230.

Disposed in the cushion component 110 are one or more joints. The joints (e.g., first joint 141, second joint 142, third joint 143) are places wherein the top surface 112 is bent inwardly toward the bottom surface 113. The joints do not close off the first side extension 210, second side extension 220, and bottom extension 230 from the center space 200. Air 160 can flow throughout each part of the cushion component 110. The joints provide places where the cushion component 110 can be slightly bent (e.g., a hinge-like manner) to fit around the child's body. The joints do not cause the extensions to be floppy.

In some embodiments, the cushion component 110 comprises three joints (see FIG. 1, FIG. 2), for example a first joint 141 in between the center space 200 and the first side extension 210, a second joint 142 in between the center space 200 and the second side extension 220, and a third joint 143 in between the center space 200 and the bottom extension 230. In some embodiments, the third joint 143 is generally V-shaped. In some embodiments, this shape can help prevent the bottom extension 230 from filling up too much with air 160.

The inflatable support cushion 100 can be inserted into a seat device 101 such that the top surface 112 of the cushion component 110 is flush with the child's back. The bottom extension 230 can be bent slightly underneath the child's bottom. The first side extension 210 and second side extension 220 can be wrapped around the child's back, for example pivoted toward the child's abdomen (see FIG. 6).

The inflatable support cushion 100 may be constructed in a variety of sizes to accommodate babies and children. In some embodiments, the cushion component 110 is between about 10 to 14 inches in length 310. In some embodiments, the cushion component 110 is between about 14 to 18 inches in length 310. In some embodiments, the cushion component 110 is more than about 18 inches in length 310.

In some embodiments, the cushion component 110 is between about 6 to 9 inches in width 230. In some embodiments, the cushion component 110 is between about 9 to 12 inches in width 230. In some embodiments, the cushion component 110 is more than about 12 inches in width 230.

As used herein, the term "about" refers to plus or minus 10% of the referenced number. For example, an embodiment wherein the cushion component is about 12 inches in width includes a cushion component that is between 10.8 and 13.2 inches in width.

The inflatable support cushion 100 may be constructed in a variety of designs to provide aesthetic appeal. The inflatable support cushion 100 may be constructed from a variety of materials. For example, in some embodiments, the inflatable support cushion 100 is constructed from a plastic, vinyl, the like, or a combination thereof.

The following the disclosures of the following U.S. Patents are incorporated in their entirety by reference herein: U.S. Pat. No. 6,233,767; U.S. Pat. No. 5,996,153; U.S. Pat. No. 6,012,778; U.S. Pat. No. 6,354,665; U.S. Pat. No. 5,095,567.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An inflatable support cushion comprising:

(a) a generally hollow T-shaped cushion component divided into a center space, a first side extension, a second side extension, and a bottom extension; wherein the cushion component has a top surface, a bottom surface, an inner cavity, and a valve movable between an open position and a closed position for respectively allowing or preventing access to the inner cavity; wherein the cushion component can be inflated with air via the valve; and (b) a first joint in between the center space and the first side extension, a second joint in between the center space and the second side extension, and a third joint in between the center space and the bottom extension; each joint being a place where the top surface is bent inwardly toward the bottom surface; wherein the cushion component can be slightly bent at each joint wherein the third joint is generally V-shaped to help reduce the air that can fill the bottom extension.

2. The inflatable support cushion of claim 1, wherein the inflatable support cushion is constructed from a material comprising a plastic, vinyl, the like, or a combination thereof.

* * * * *